United States Patent [19]

Murakami et al.

[11] Patent Number: 4,495,009

[45] Date of Patent: Jan. 22, 1985

[54] METHOD OF COOLING COLD STEEL STRIP WITH COOLING ROLLS

[75] Inventors: Shinjiro Murakami; Osamu Hashimoto, both of Kurashiki; Kazuo Morimoto; Kaneaki Hyodo, both of Hiroshima, all of Japan

[73] Assignees: Kawasaki Steel Corporation, Kobe; Mitsubishi Heavy Industries, Ltd., Tokyo, both of Japan

[21] Appl. No.: 511,561

[22] Filed: Jul. 6, 1983

[30] Foreign Application Priority Data

Jul. 8, 1982 [JP] Japan ..... 57-117758

[51] Int. Cl.[3] ..... C21D 1/18

[52] U.S. Cl. ..... 148/128; 148/155; 148/156

[58] Field of Search ..... 148/143, 153, 155, 156, 148/157, 128; 266/109, 113; 72/201

[56] References Cited

U.S. PATENT DOCUMENTS 2,189,836 2/1940 Schon ..... 266/109

FOREIGN PATENT DOCUMENTS 23036 2/1982 Japan ..... 148/156
23032 2/1982 Japan ..... 266/109
23035 2/1982 Japan ..... 266/109
23037 2/1982 Japan ..... 266/109

*Primary Examiner*—M. J. Andrews
*Assistant Examiner*—Christopher W. Brody
*Attorney, Agent, or Firm*—Balogh, Osann, Kramer, Dvorak, Genova & Traub

[57] ABSTRACT

A method of cooling band or hoop steels with hollow cooling rolls through which a cooling medium flows to absorb the heat of the steel strips trained about and in contact with the hollow cooling rolls, thereby cooling the steel strips. According to the invention this method is carried out so as to fulfil the following equation (1) with the cooling roll having a diameter $D > 600$ mm when a thickness h of the steel strip is within $0.2 \leqq h < 0.6$ mm, $$\Delta T_S < 0.65 \cdot \sigma_T^{1.5} \cdot \theta \cdot h^{-0.75} \quad (1)$$

and so as to fulfil the following equation (2) with the cooling roll having a diameter $D > 1{,}000$ mm when a thickness h of the steel strip is within 0.6 mm $\leqq$ h, $$\Delta T_S < 1.05 \cdot \sigma_T^{1.5} \cdot \theta \cdot h^{-0.83} \quad (2)$$

where $\Delta T_S$ is temperature fall °C. per one cooling roll, $\sigma_T$ is tensile stress in a lengthwise direction of the steel strip and $\theta$ is winding angle about the cooling roll.

1 Claim, 14 Drawing Figures

METHOD OF COOLING COLD STEEL STRIP WITH COOLING ROLLS

BACKGROUND OF THE INVENTION

1. Field of the Invention

This invention relates to a roll cooling method for cooling cold steel strips, and more particularly to a method of cooling steel stripe with rolls in a heat treatment line, particularly continuous annealing process line or continuous plating line.

2. Description of the Prior Art

It has been generally known to continuously cool a cold steel strip in contact with and running about a hollow roll with the aid of heat transfer between the steel strips and a cooling medium flowing through an inner cavity of the roll. However, the steel strip cooled by such a roll cooling method often does not keep its flatness after cooled and tends to cause defects such as wave-like deformations, wrinkles or folds which inadmissibly reduce its value in article of commerce.

There are two factors making defective the shape or appearance of the steel strip. One relates to an accuracy of an apparatus, such as deviated shapes of cooling roll surfaces, dirty surfaces of the cooling rolls, incorrect setting of the cooling rolls and the like. The other relates to an operating condition such as unsuitable selections of cooling roll diameters, lengthwise tensile forces acting upon steel strips, cooling extent for steel strips, winding angles of the steel strips which are central angles at centers of the rolls subtended by parts of the steel strips wound about the rolls, and the like.

SUMMARY OF THE INVENTION

It is an object of the invention to provide an improved method of cooling steel strips with cooling rolls, which limits the above operating conditions within predetermined ranges to remove the above source causing shapes of the steel strips to be defective, thereby keeping the flatness of the steel strips after cooled.

In order to achieve the above object, according to the invention the method of cooling a steel strip with a hollow cooling roll by means of thermal transmission through the roll between a cooling medium flowing through an internal cavity of said cooling roll and said steel strips being in contact with and running about said cooling roll is carried out so as to fulfil the following equation (1) with said cooling roll having a diameter $D>600$ mm when a thickness h of said steel strip is within $0.2 \leqq h < 0.6$ mm, $$\Delta T_S < 0.65 \cdot \sigma_T^{1.5} \cdot \theta \cdot h^{-0.75} \quad (1)$$

and so as to fulfil the following equation (2) with said cooling roll having a diameter $D>1{,}000$ mm when a thickness h of said steel strip is within $0.6 \text{ mm} \leqq h$, $$\Delta T_S < 1.05 \cdot \sigma_T^{1.5} \cdot \theta \cdot h^{-0.83} \quad (2)$$

where $\Delta T_S$ is temperature fall °C. per one cooling roll, $\sigma_T$ is tensile stress in a lengthwise direction of said steel strip and $\theta$ is winding angle about said cooling roll.

In order that the invention may more clearly understood, preferred embodiments will be described, by way of example, with reference to the accompanying drawings.

DETAILED DESCRIPTION OF THE PREFERRED EMBODIMENT

In general, when a cold steel strip is wound about a cooling roll, a central angle at a center of the roll subtended by a part of the steel strip actually in contact with the roll is different from a central angle at the center of the roll subtended by a part of the steel intended to wind about the roll depending upon a rigidity of the steel strip because of a tendency of the steel strip to become straight. In this specification and claims, a central angle at a center of the roll subtended by a part of the steel strip actually in contact with the roll is referred to as "contact" angle, and a central angle at a center of the roll subtended by a part of the steel intended to wind about the roll is referred to as "winding" angle which is a theoretical or geometrical angle. It has been found that a flatness of a steel strip is affected by a temperature distribution on the steel strip in its traverse or lateral direction, which is in turn dependent upon the contact angle and cooling action of the roll.

The inventors of this application have further investigated the factor concerning the operating condition which makes defective the shape or appearance of a steel strip after cooled, in cooling by a cooling medium 3 flowing as shown by an arrow through a cavity of a hollow cooling roll 2 about which a steel strip 1 is trained. As the result, the following matters have been found.

Figure 1:
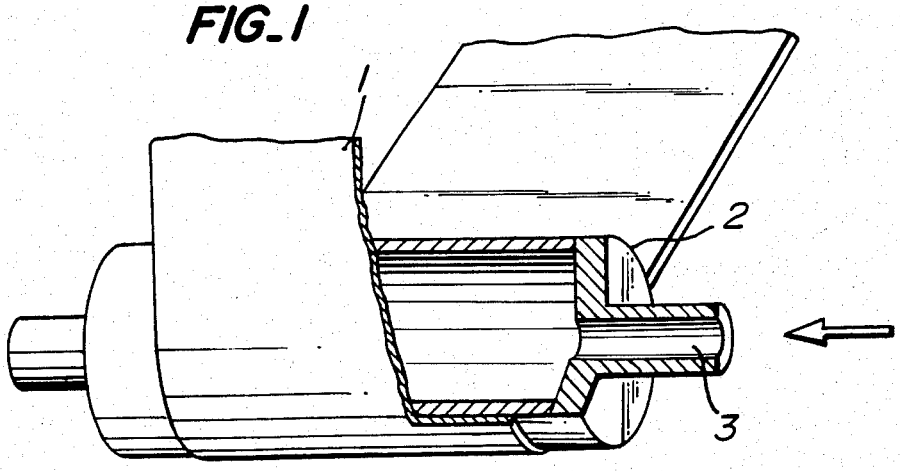
FIG. 1 is a schematic perspective view of a steel band being cooled by a hollow cooling roll partially removed.
Figure 2:
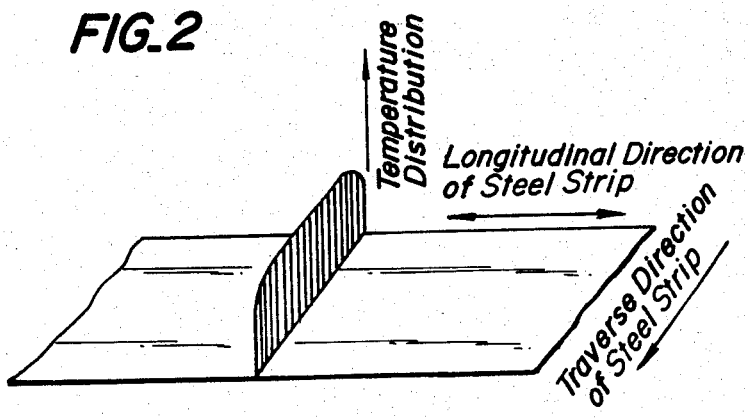
FIG. 2 shows a temperature distribution in a traverse direction of a steel strip being cooled by a roll.
Figure 3:
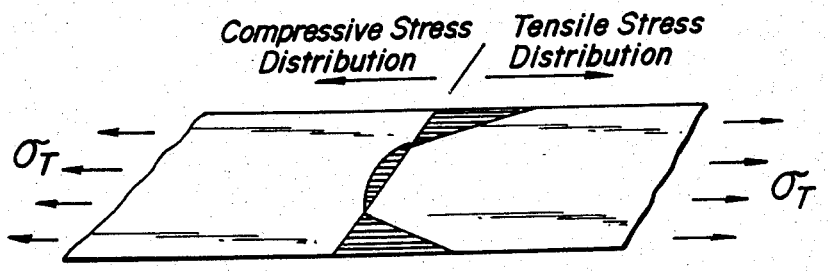
FIG. 3 illustrates a stress distribution in the traverse direction of the steel strip shown in FIG. 2.
Figure 4:
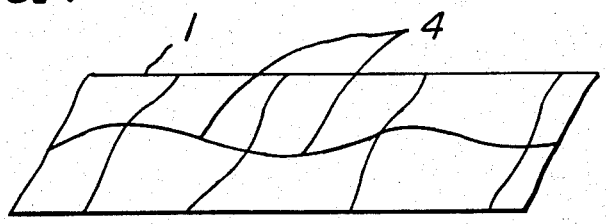
FIG. 4 is a perspective view of a steel strip which is defectively deformed due to the stresses.

The defective deformation of the steel strip is fundamentally due to the fact that a temperature distribution on the steel band 1 in its traverse direction is uneven as shown in FIG. 2 to cause a stress distribution in its longitudinal direction as shown in FIG. 3. In other words, compressive stresses occur in the part of the steel strip where the temperature is relatively high as shown in FIG. 3. When the compressive stresses exceed a determined value, the steel strip can no longer keep its flatness to cause a buckling resulting in a deformed steel strip as shown in FIG. 4.

The temperature difference in the traverse direction of the steel strip is caused by the fact that when a steel strip 1 is wound about a cooling roll 2, a contact angle $\theta_2$ is generally smaller than a winding angle $\theta_1$ which is geometrical. A reference numeral 5 in FIG. 5 denotes tangential lines to a circle of the roll 2. The winding and contact angles $\theta_1$ and $\theta_2$ have the following relations.

(1) When tensile forces in the longitudinal direction of the steel strip are increased, the contact angle $\theta_2$ approaches the winding angle $\theta_1$.

(2) As a diameter of the cooling roll increases, the contact angle $\theta_2$ approaches the winding angle $\theta_1$.

(3) As a thickness of the steel strip decreases, the contact angle $\theta_2$ approaches the winding angle $\theta_1$.

The above relations (1), (2) and (3) are indicated as an equation (A).

$$\theta_1 - \theta_2 = I\frac{h^c}{\sigma_T{}^a \cdot D^d} \tag{A}$$

where h: thickness of the steel (mm)

$\sigma_T$: tensile stress (kg/mm$^2$) in a longitudinal direction of the steel strip D: diameter of the cooling roll (mm)

I: a positive coefficient a, b, and c: positive factors

Figure 6:
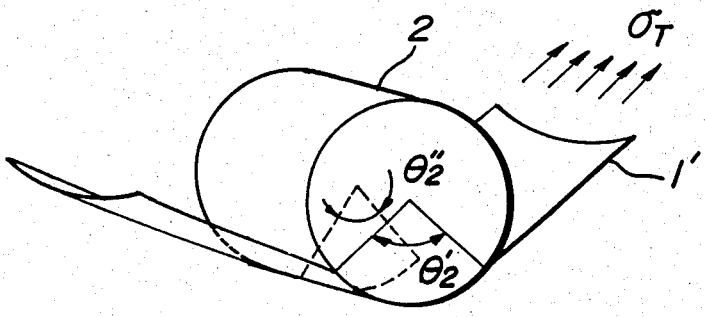
FIG. 6 is a schematic perspective view of a contact angle distribution of a steel strip about a cooling roll.

In addition, if tensile stresses $\sigma_T$ in the longitudinal direction of the steel strip 1, winding about the cooling roll 2 are not uniform in the traverse direction of the steel strip, contact angles $\theta_2$ in parts of the steel strip subjected to higher tensile stress are larger than those in parts of the steel subjected to lower tensile stress. For example, when the tensile forces in the proximity of edges of the steel strip are higher than those in the center of the steel strip, contact angles $\theta'_2$ at the edges are larger than contact angles $\theta''_2$ at the center of the steel strip as shown in FIG. 6. In the event that contact angles $\theta_2$ are different in the traverse direction of the steel strip, the parts of the steel having larger contact angles $\theta_2$ will be in contact with the cooling roll for a longer period of time than that of the smaller contact angles $\theta_2$, so that the temperature fall in the former parts is more than that in the latter parts to provide temperature differences in the traverse direction of the steel strip. The temperature difference in the traverse direction is caused in this manner.

Upon denoting the temperature difference in the traverse direction of the steel strip by $\Delta\Delta T_S$, it is indicated in the following equation (B) with temperature fall $\Delta T_S$ of the steel strip per one cooling roll, an average contact angle $\theta$ among contact angles selected along the traverse direction and a difference $\Delta\theta$ between the contact angles.

$$\Delta\Delta T_S = K \times \frac{\Delta\theta}{\theta} \times \Delta T_S \tag{B}$$

where K is a constant.

As can be seen from the equation (B), it is clear that (1) the larger the temperature fall $\Delta T_S$ of the steel, the larger is the temperature difference $\Delta\Delta T_S$ in the traverse direction, (2) the larger the difference $\Delta\theta$ in contact angle, the larger is the temperature difference $\Delta\Delta T_S$ and (3) the smaller the average contact angle $\theta$, the larger is the temperature difference $\Delta\Delta T_S$.

Figure 5:
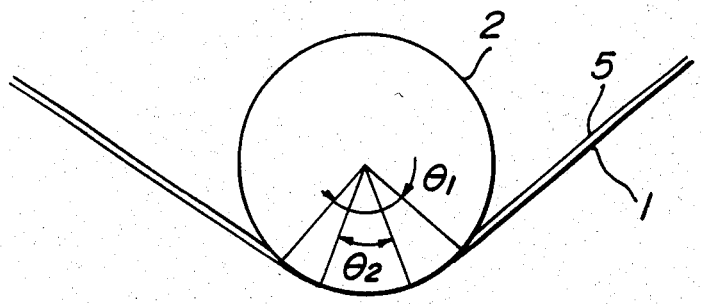
FIG. 5 is an explanatory view of a winding angle $\theta_1$ and a contact angle $\theta_2$ of a steel strip about a cooling roll.

The contact angle difference $\Delta\theta$ corresponds to $\theta_1$–$\theta_2$ in FIG. 5. Accordingly, the value $\Delta\theta$ is determined by the tensile stress $\sigma_T$ in the lengthwise direction of the steel strip, the diameter D of the cooling roll and the thickness h of the steel strip as above described.

The buckling of the steel strip is caused by the compressive forces in the steel due to the temperature difference in the traverse direction of the steel as above described. The steel strip is thus likely to cause the buckling in the event of the larger temperature difference $\Delta\Delta T_S$ in the traverse direction. Accordingly, a buckling limit of a steel strip in roll cooling can be considered correspondingly to the temperature difference $\Delta\Delta T_S$ in the traverse direction.

As above described, the factors for determining the temperature difference $\Delta\Delta T_S$ are the temperature fall $\Delta T_S$ per one cooling roll, the average contact angle $\theta$ and contact angle difference $\Delta\theta$ in the traverse direction. On the other hand, the factors for determining the contact angle difference $\Delta\theta$ are the tensile stress $\sigma_T$ in the lengthwise direction of the steel strip, the diameter D of the cooling roll and the thickness h of the steel strip. The temperature difference $\Delta\Delta T_S$ is indicated by the following equation (c) by substituting the equation (A) with the relation $\Delta\theta = \theta_1 - \theta_2$ into the equation (B).

$$\Delta\Delta T_S = K \times I \times \frac{h^c}{\sigma_T{}^a \cdot D^b \cdot \theta} \times \Delta T_S \tag{C}$$

If the value $\Delta\Delta T_S$ is less than a determined value, no buckling can occur any longer in the steel strip. If such a determined value is denoted by J, the condition $J > \Delta\Delta T_S$ for avoiding the buckling of the steel strip is expressed by an equation (D) from (C)

$$\Delta T_S < \frac{J}{K \times I} \times \sigma_T{}^a \times D^b \times \theta \times h^{-c} \tag{D}$$

Now, the diameter D of the cooling roll is limited in a relation $$\frac{J}{K \times I} \times D^b = F,$$

so that the equation (D) is simplified as an equation (E).

$$\Delta T_S < F \times \sigma_T{}^a \times \theta \times h^{-c} \tag{E}$$

The condition in roll cooling for avoiding the buckling of the steel strip can be obtained by determining the factors F, a and c. The inventors determined values of these factors by the following experiment.

Experiment I

Figure 7:
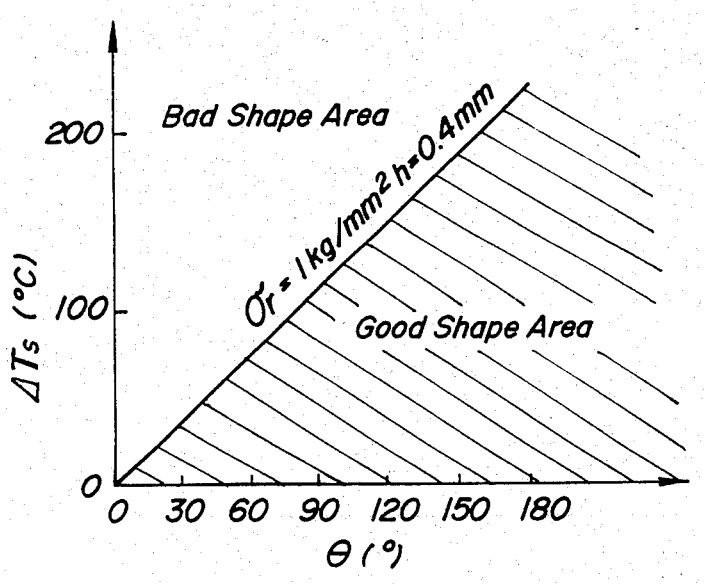
FIG. 7 is a graph illustrating a relation between temperature falls $\Delta T_S$ per one roll and average winding angles $\theta$ of steel strips having a 0.4 mm thickness about rolls having 600 mm diameters.

Steel bands having thicknesses within $0.2 \leqq h < 0.6$ mm were cooled by cooling rolls having a diameter of 600 mm with tensile stresses 0–4 kg/mm$^2$. FIG. 7 illustrates a part of results of the experiment, wherein the steel strips of a thickness $h = 0.4$ mm are subjected to a tensile stress $\sigma_T = 1$ kg/mm$^2$ to study values $\theta$, $\Delta T_S$ and limits of acceptable cooled steel shapes.

Figure 11:
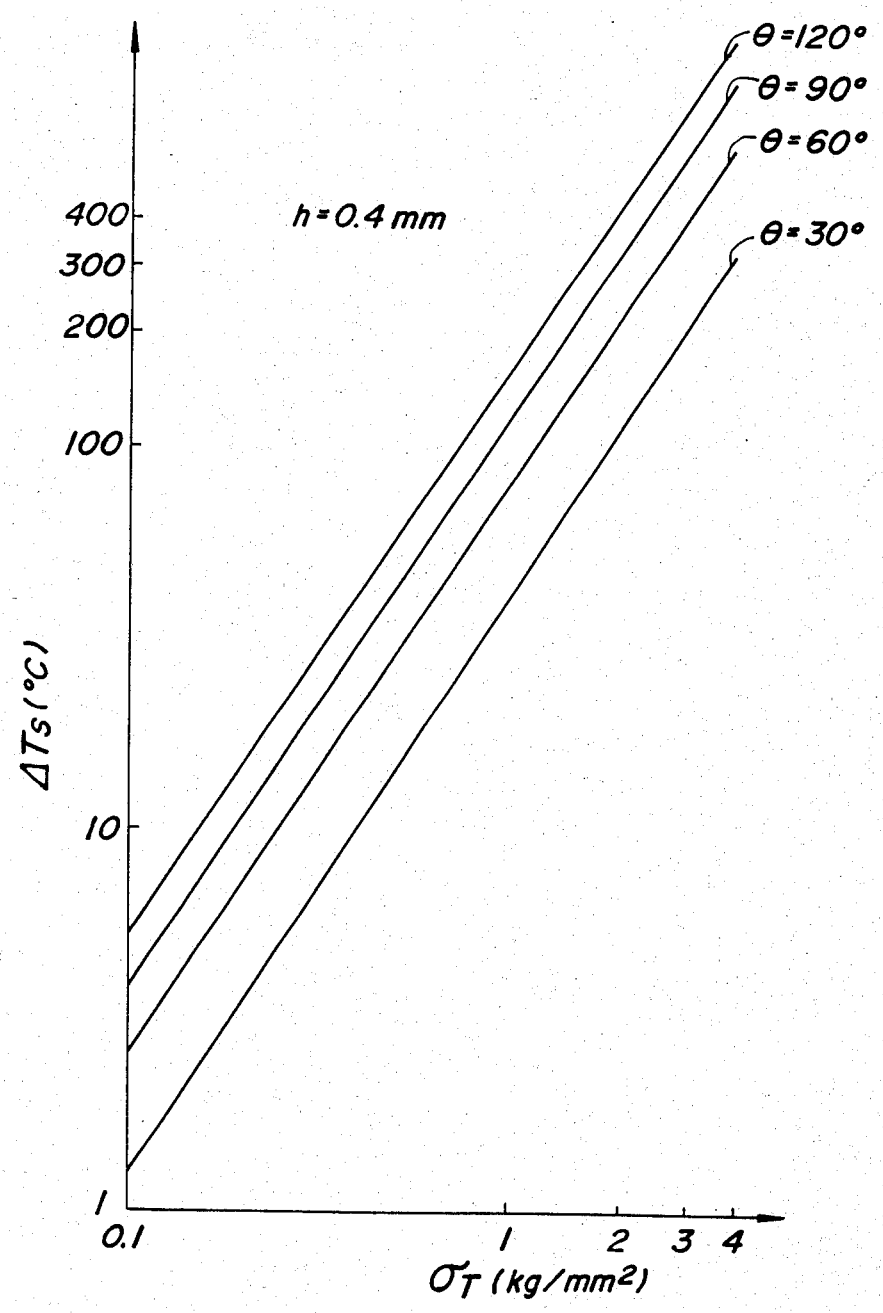
FIG. 11 is a graph illustrating relations between temperature falls $\Delta T_S$ per one roll and tensile stresses $\sigma_T$, with steel strips having a 0.4 mm thickness wound with average winding angles $\theta = 30°$, 60°, 90° and 120°.
Figure 12:
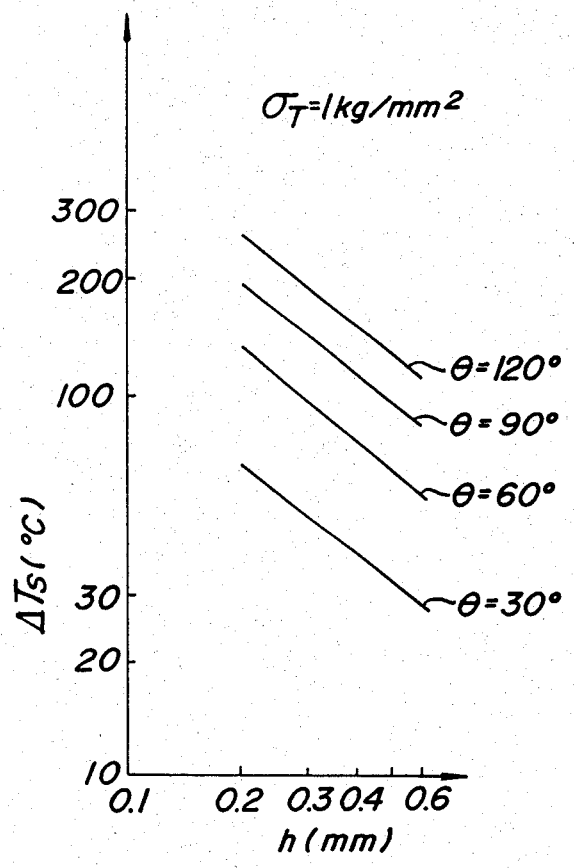
FIG. 12 is a graph showing relations between temperature falls $\Delta T_S$ per one roll and thickness h of steel strips wound thereabout with average winding angles $\theta = 30°$, 60°, 90° and 120° and subjected to 1 kg/mm$^2$ tensile stresses.

FIG. 11 illustrates relations between the temperature fall $\Delta T_S$ and the tensile stress $\sigma_T$ with steel strips of a thickness $h = 0.4$ mm wound about cooling rolls with winding angles of 30°, 60°, 90° and 120°. Areas below the respective straight lines in FIG. 11 are good shape areas. FIG. 12 shows relations between the temperature fall $\Delta T_S$ and thickness h of steel strips subjected to tensile stress 1 kg/mm$^2$ with winding angles $\theta$. Areas below the respective straight lines are good shape areas. The factors in the equation (E) were determined by using the above results of the experiment to obtain an equation (1).

$$\Delta T_S < 0.65 \cdot \sigma_T^{1.5} \cdot \theta \cdot h^{-0.75} \quad (1)$$

In this case, $\theta$ represents "winding" angle, because the difference between the contact and winding angles is very small in comparison with the actual winding angles such as 30°–120° and the actual operation should be controlled by winding angles instead of theoretical contact angles. The "winding" angle $\theta$ is therefore used in substitution for "contact" angle hereinafter and in claim.

Experiment II

Figure 8:
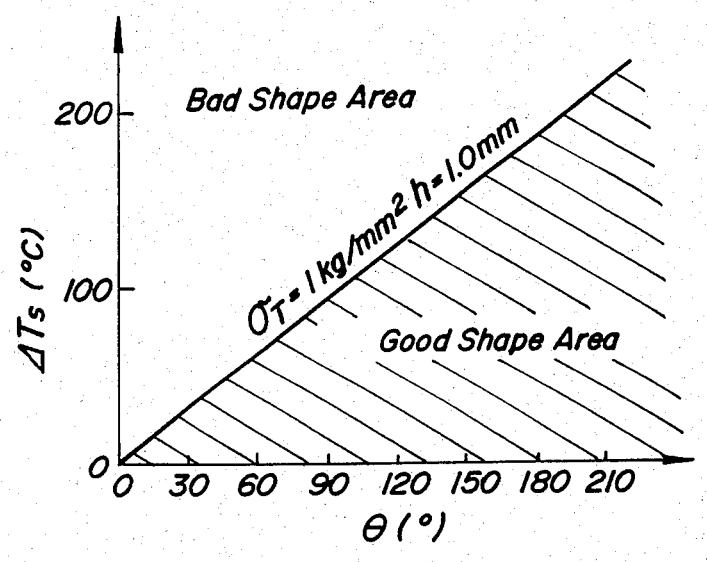
FIG. 8 is a graph similar to FIG. 7 but with steel strips having a 1.0 mm thickness and rolls having 1,000 mm diameters.

Steel bands having thicknesses within $0.6 \leqq h \leqq 2.3$ mm were cooled by cooling rolls having a diameter of 1,000 mm with tensile stresses 0–4 kg/mm$^2$. FIG. 8 illustrates a part of results of the experiment, in which the steel strips of a thickness $h = 1.0$ mm are subjected to a tensile stress $\sigma_T = 1$ kg/mm$^2$ to study values $\theta$, $\Delta T_S$ and limits of acceptable cooled steel shapes.

Figure 13:
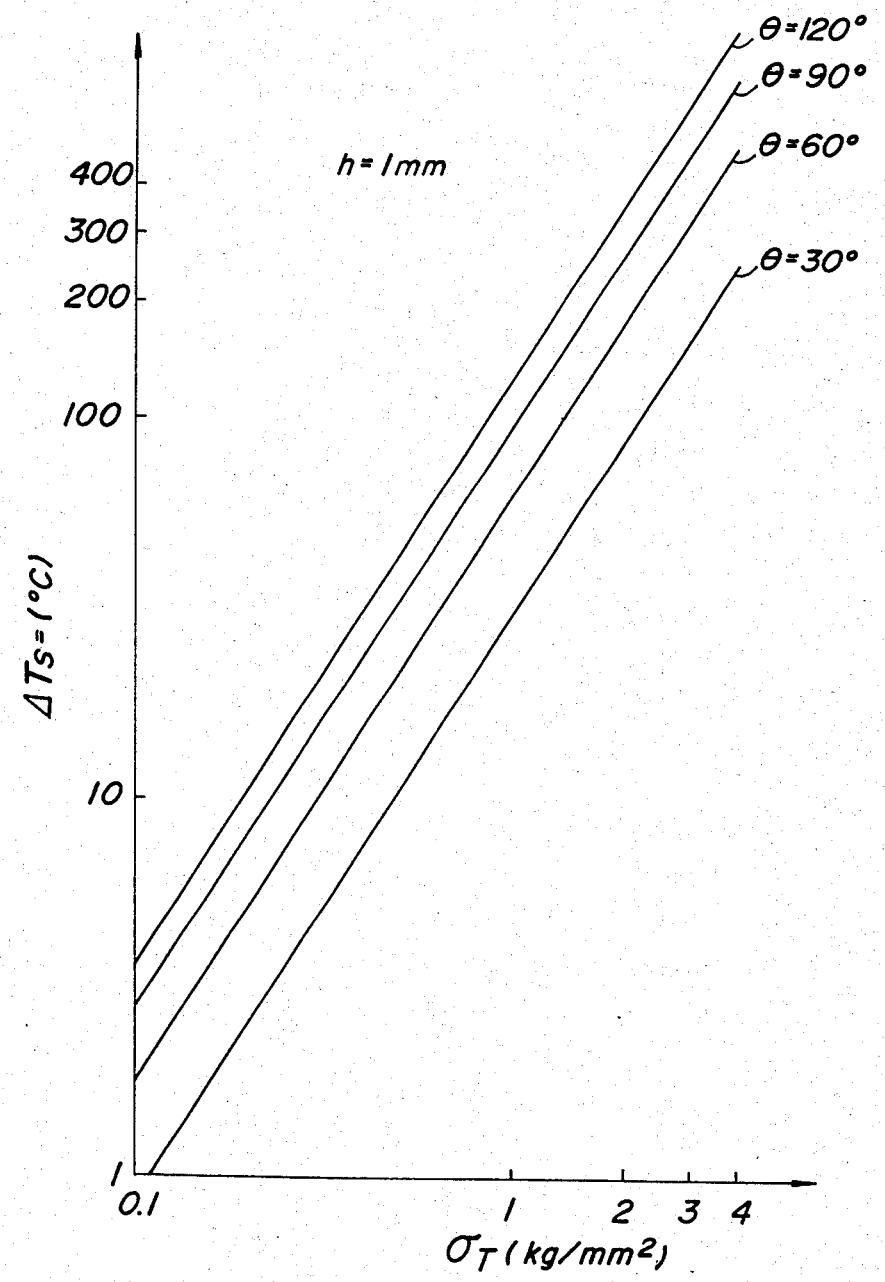
FIG. 13 is a graph similar to FIG. 11 but with steel strips having a 1 mm thickness.
Figure 14:
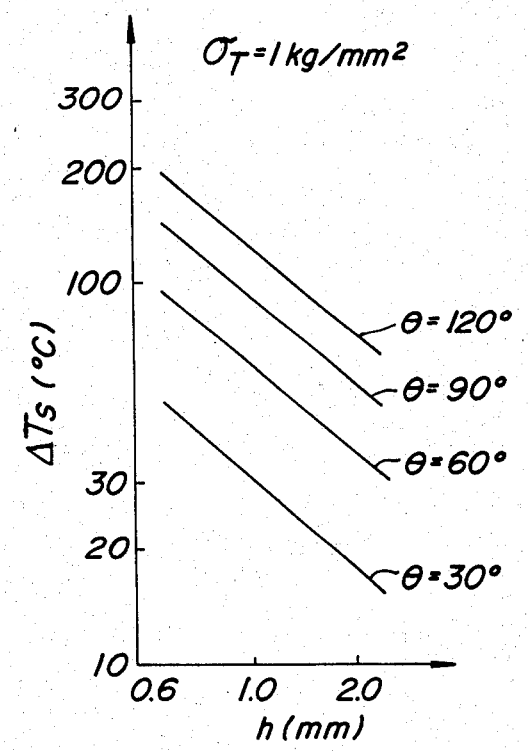
FIG. 14 is a graph similar to FIG. 12 but steel strips thicker than those in FIG. 12.

FIG. 13 illustrates relations between the temperature fall $\Delta T_S$ and the tensile stress $\sigma_T$ with steel strips of a thickness $h = 1.0$ mm wound about cooling roll with winding angles of 30°, 60°, 90° and 120°. Areas below the respective straight lines in FIG. 13 are good shape areas. FIG. 12 shows relations between the temperature fall $\Delta T_S$ and thickness of steel strips subjected to tensile stress 1 kg/mm$^2$ with winding angles. Areas below the respective straight lines are good shape areas. The factors in the equation (E) were determined by using the above results of the experiment to obtain an equation (2).

$$\Delta T_S < 1.05 \cdot \sigma_T^{1.5} \cdot \theta \cdot h^{-0.83} \quad (2)$$

With cooling rolls having diameters larger than those used in the above experiments, the range of the temperature fall $\Delta T_S$ becomes wider as can be seen from the equation (D). When the temperature fall $\Delta T_S$ is within the ranges of the equations (1) and (2), respectively for the specified thicknesses of the steel strips and diameters of the cooling rolls, the steel strips can be cooled keeping the steel strips in good shapes.

Figure 9:
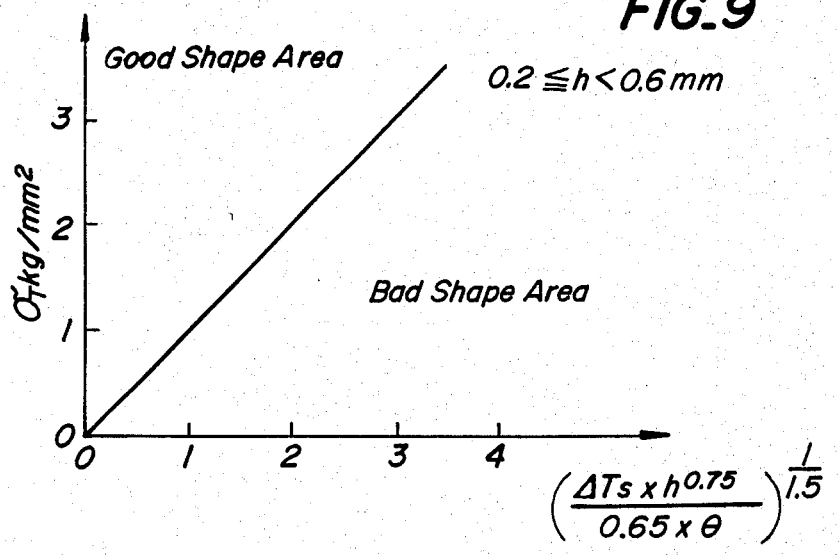
FIG. 9 is a graph illustrating an adoptable tensile stress range in longitudinal direction of steel strips having thicknesses $0.2 \leqq h < 0.6$ mm wound about rolls having 1,000 mm diameters.

FIG. 9 illustrates relations between the tensile stress $\sigma_T$ and the remaining factors $$\left( \frac{\Delta T_S \cdot h^{0.75}}{0.65 \cdot \theta} \right)^{\frac{1}{1.5}}$$

with steel strips of thicknesses $0.2 \leqq h < 0.6$ mm using rolls having 1,000 mm diameters showing how the tensile stress affects the shapes of the cooled steel strips. It represents substantially the same relation as the equation (1).

Figure 10:
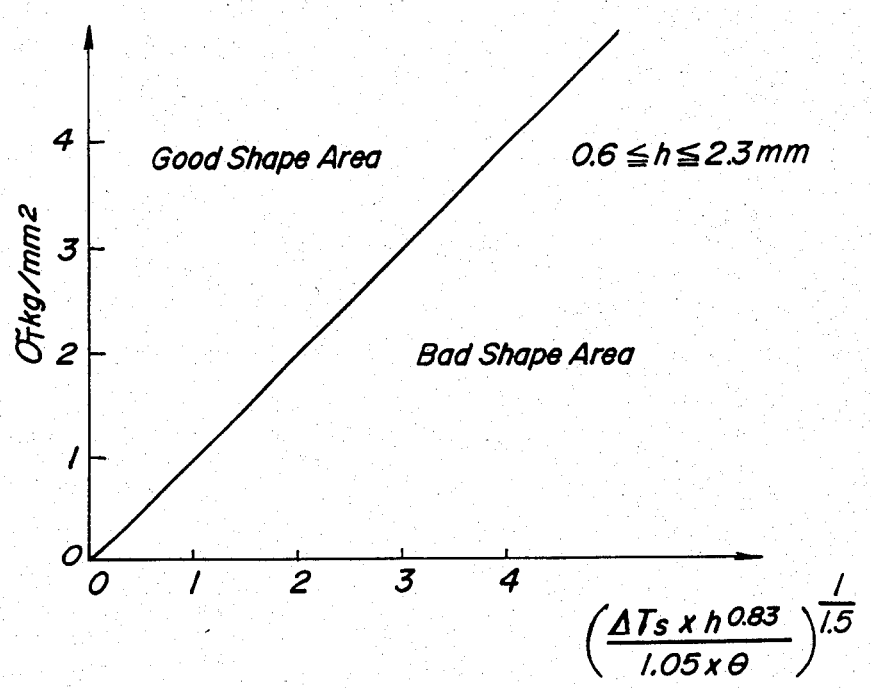
FIG. 10 is a graph similar to FIG. 9 but with steel strips having thicknesses $0.6 \leqq h \leqq 2.3$ mm and rolls having 1,200 mm diameters.

FIG. 10 illustrates the relations similar to those in FIG. 9 with exception of the thicknesses $0.6 \leqq h \leqq 2.3$ mm of steel strips and diameters 1,200 mm of the cooling rolls.

The following conclusion was obtained from the above experiments of roll cooling.

1. When steel strips of thicknesses of $0.2 \leqq h < 0.6$ mm are treated, the roll cooling operation can be effected without any defective change in shape of the steel strip by fulfilling the condition of the equation (1)

$$\Delta T_S < 0.65 \cdot \sigma_T^{1.5} \cdot \sigma \cdot h^{-0.75},$$

with cooling rolls of more than 600 mm diameters.

2. When steel strips having thicknesses within $0.6 \leqq h \leqq 2.3$ mm are treated, the roll cooling operation can be effected without any defective change in shape of the steel strip by fulfilling the condition of the equation (2)

$$\Delta T_S < 1.05 \cdot \sigma_T^{1.5} \cdot \theta \cdot h^{-0.83},$$

with cooling rolls of more than 1,000 mm diameters.

FIGS. 9 and 10 clearly illustrate the relations between principal factors including thicknesses of steel strips defectively affecting their shapes after cooled, so that roll cooling conditions without causing any defective change in shape of the steel strip can easily be determined depending upon the thicknesses of the steel strip to be cooled.

As can be seen from the above description, according to the invention steel strips can be properly cooled with cooling rolls without any defective deformation of the steels.

It is further understood by those skilled in the art that the foregoing description is that of the preferred embodiment of the disclosed method and that various changes and modifications may be made in the invention without departing from the spirit and scope thereof.

What is claimed is:

1. A method of cooling a steel strip with a hollow cooling roll by means of thermal transmission through the roll between a cooling medium flowing through an internal cavity of said cooling roll and said steel strip being in contact with and running about said cooling roll, wherein said method comprises the steps of obtaining uniform contact between the strip and cooling rolls, controlling the temperature fall of the strip per each cooling roll, and controlling tensile forces on the strip, said method being carried out so as to fulfil the following equation (1) with said cooling roll having a diameter $D > 600$ mm when a thickness h of said steel strip is within $0.2 \leqq h < 0.6$ mm, $$\Delta T_S < 0.65 \cdot \sigma_T^{1.5} \cdot \theta \cdot h^{-0.75} \quad (2)$$

and so as to fulfil the following equation (2) with said cooling roll having a diameter $D > 1{,}000$ mm when a thickness h of said steel strip is within 0.6 mm $\leqq h$, $$\Delta T_S < 1.05 \cdot \sigma_T^{1.5} \cdot \theta \cdot h^{-0.83} \quad (2)$$

where $\Delta T_S$ is temperature fall °C. per one cooling roll, $\sigma_T$ is tensile stress in a lengthwise direction of said steel strip and $\theta$ is winding angle about said cooling roll.

* * * * *